US009602937B2

(12) United States Patent
Snider et al.

(10) Patent No.: US 9,602,937 B2
(45) Date of Patent: Mar. 21, 2017

(54) METHOD AND APPARATUS TO PROVIDE SURROUNDINGS AWARENESS USING SOUND RECOGNITION

(71) Applicant: Continental Automotive Systems, Inc., Auburn Hills, MI (US)

(72) Inventors: James R. Snider, Kildeer, IL (US); Erick A. Boughton, Morton Grove, IL (US); William J. Klein, Naperville, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 52 days.

(21) Appl. No.: 14/255,008

(22) Filed: Apr. 17, 2014

(65) Prior Publication Data

US 2015/0304784 A1 Oct. 22, 2015

(51) Int. Cl.

| | |
|---|---|
| ***G08G 1/0965*** | (2006.01) |
| ***G08G 1/16*** | (2006.01) |
| ***H04R 29/00*** | (2006.01) |

(52) U.S. Cl.

CPC ..... *H04R 29/00* (2013.01); *G08G 1/0965* (2013.01); *G08G 1/166* (2013.01); *H04R 2499/13* (2013.01)

(58) Field of Classification Search

CPC .. H04R 29/00; H04R 2499/13; G08G 1/0965; G08G 1/166

See application file for complete search history.

(56) References Cited

U.S. PATENT DOCUMENTS

| | | | | |
|---|---|---|---|---|
| 3,182,288 | A | 5/1965 | Smith | |
| 3,412,378 | A | 11/1968 | Thomas | |
| 3,568,144 | A | 3/1971 | Streb | |
| 3,859,623 | A | 1/1975 | Koehler | |
| 4,587,522 | A | 5/1986 | Warren | |
| 5,839,109 | A * | 11/1998 | Iwamida | G10L 17/26 704/236 |
| 7,245,232 | B1 | 7/2007 | Caouette, Sr. | |
| 8,432,275 | B2 * | 4/2013 | Patel | H04M 1/72572 340/539.1 |
| 2007/0092087 | A1 * | 4/2007 | Bothra | H04M 1/6058 381/74 |
| 2007/0127879 | A1 * | 6/2007 | Frank | H03G 3/32 386/234 |
| 2008/0240458 | A1 * | 10/2008 | Goldstein | H04R 25/453 381/72 |
| 2008/0267416 | A1 * | 10/2008 | Goldstein | H04R 1/1091 381/56 |
| 2010/0033313 | A1 * | 2/2010 | Keady | G08G 1/0965 340/438 |
| 2010/0119076 | A1 * | 5/2010 | Monk | A61F 11/14 381/71.6 |

(Continued)

OTHER PUBLICATIONS

Search Report dated Nov. 24, 2014, from corresponding GB Patent Application No. GB1412239.4.

*Primary Examiner* — Sonia Gay

(57) ABSTRACT

Surrounding awareness is provided using sound recognition by detecting sound, determining frequency components of the detected sound and comparing the frequency components of the detected sound to the frequency components of known sound sources. If the components of a known sound source are detected, the source of the sound is determined to be present. An appropriate warning or enunciation of the sound source is provided.

2 Claims, 4 Drawing Sheets

Table 1a.
Five Chime Horns, Notes and Corresponding Frequencey (Hz)

| K5LA | K5H | P5 (original tuning) | P5 (newer casting) | P5A |
|---|---|---|---|---|
| D# (311) | D# (311) | C# (277) | D (292) | C# (277) |
| F# (370) | F# (370) | E (330) | F (349) | E (330) |
| G# (415) | A# (470) | G (392) | G# (415) | G (392) |
| B (494) | C (523) | A (440) | A (440) | A# (470) |
| D# octave (622) | D# octave (622) | C# octave (554) | C(523) | C# octave (554) |

(56) References Cited

U.S. PATENT DOCUMENTS

| | | | | |
|---|---|---|---|---|
| 2011/0096631 | A1* | 4/2011 | Kondo | H04R 1/406<br>367/117 |
| 2013/0109909 | A1* | 5/2013 | van Gerwen | H04R 25/43<br>600/25 |

* cited by examiner

Table 1a.
Five Chime Horns, Notes and Corresponding Frequencey (Hz)

| K5LA | K5H | P5 (original tuning) | P5 (newer casting) | P5A |
|---|---|---|---|---|
| D# (311) | D# (311) | C# (277) | D (292) | C# (277) |
| F# (370) | F# (370) | E (330) | F (349) | E (330) |
| G# (415) | A# (470) | G (392) | G# (415) | G (392) |
| B (494) | C (523) | A (440) | A (440) | A# (470) |
| D# octave (622) | D# octave (622) | C# octave (554) | C(523) | C# octave (554) |

FIG. 1

METHOD AND APPARATUS TO PROVIDE SURROUNDINGS AWARENESS USING SOUND RECOGNITION

BACKGROUND

Noise-cancelling headphones are well known. Some noise-cancelling headphones work so well that they can impair a person's awareness of his surroundings either by effectively cancelling certain types of sounds or by providing audio content the output level of which essentially overpowers or "masks" sounds from a person's surroundings.

Similarly, the audio systems provided in many vehicles are so powerful that they too can overpower or "drown out" sounds from a person's surroundings, including for example, sounds of an approaching train or the horn of an approaching vehicle or emergency vehicle siren.

An apparatus and method by which a person can be made aware of their surroundings by recognizing certain types of sounds and providing appropriate warnings would be an improvement over the prior art.

BRIEF DESCRIPTION OF THE FIGURES

FIG. 1 is a table of the audio frequencies created by different models of train horns;

DETAILED DESCRIPTION

It is well known that train locomotives are provided with horns that create sounds to warn of the locomotives' approach. It is also well known that the sound the horns produce actually comprise multiple different frequencies and that the particular frequencies are fairly well known. The particular frequencies produced by a horn are determined by the construction of the horn itself.

FIG. 1 is a table of five columns and six rows. It shows that the model "K5LA" train horn generates a sound comprising essentially five frequencies: 311 Hz., 370 Hz., 415 Hz, 494 Hz. and 622 Hz. The train horn model "P5A" also generates five frequencies, the low note frequency being 277 Hz., three "middle" frequencies of 330 Hz., 392 Hz., and 472 Hz. and a top frequency of 554 Hz.

Those of ordinary skill in the digital signal processing art know that selectively detecting individual frequencies using a digital signal processor is a relatively straight-forward matter. Those of ordinary skill in the art also know that the Fast Fourier Transform is well suited to isolating individual frequency components in a signal. If specific notes of a train horn, such as the ones listed in FIG. 1, are detected in a sound, it can be reasonably inferred that the sound is indeed from a train horn and that a train horn is therefore nearby. Stated another way, detecting the presence or absence of certain sounds can be used to provide an awareness of the sources of such sounds and thus a knowledge or "awareness" of one's surroundings.

Figure 2:
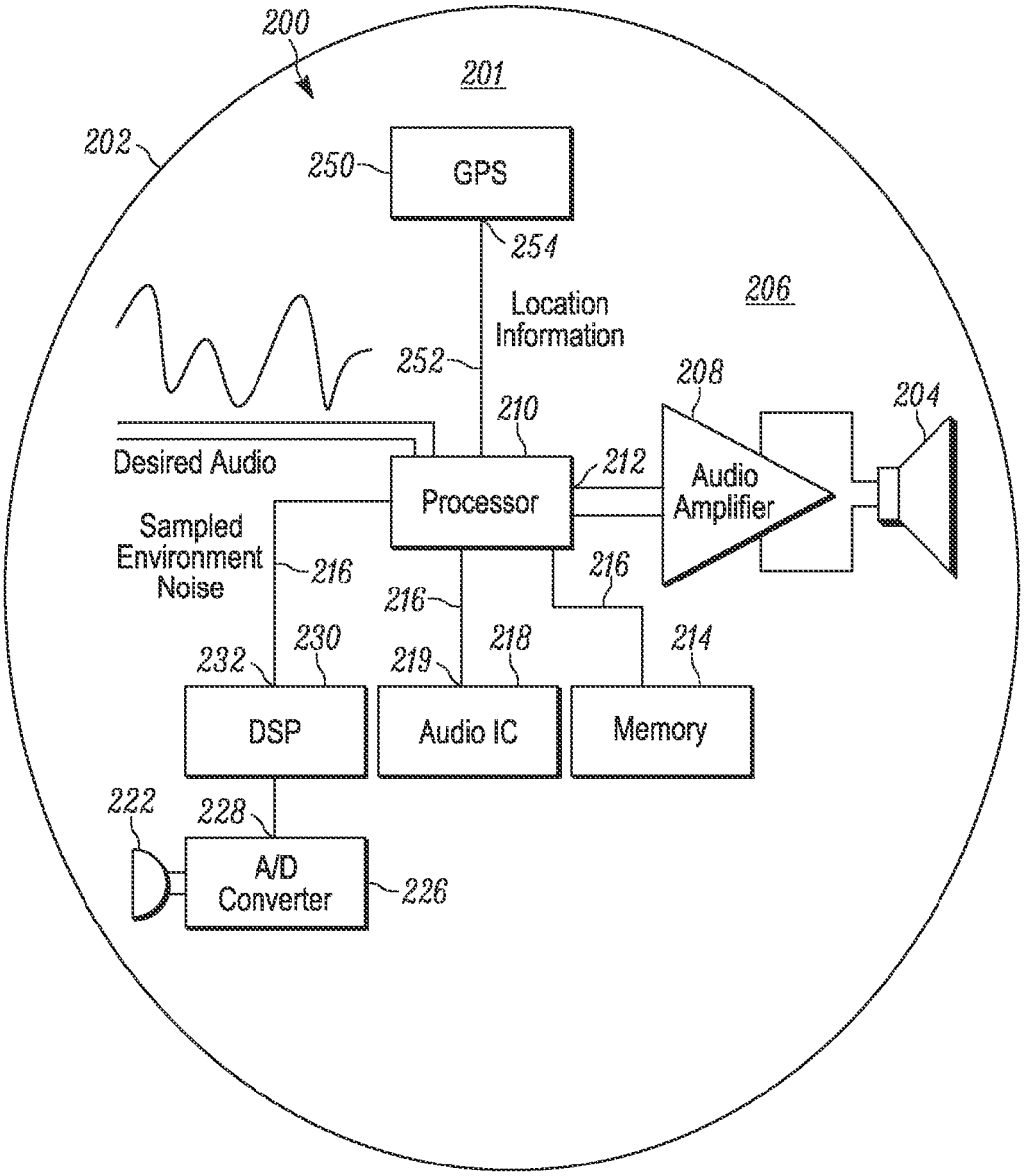
FIG. 2 is an apparatus for providing surroundings awareness by the recognition of different sounds or frequencies.

FIG. 2 depicts an apparatus 200 for providing surroundings awareness. More particularly, FIG. 2 depicts headphones 201 that are provided with the apparatus 200 inside an ear-surrounding or "circum-aural" cushion 202, which is a soft cover or wrap, large enough to extend around and over a user's ear. The cushion 202 provides an acoustic seal around the user's ear, passively cancelling noise by virtue of its soft-material construction.

Referring now to the apparatus 200, a speaker or audio driver 204 receives time-varying electrical signals generated by an audio amplifier 208. The driver 204 transduces the time-varying electrical signals into time-varying audible sound waves. Stated another way, the driver 204 converts time-varying A.C. signals into audible sound waves.

The amplifier 208 receives weak audio signals output from a processor 210. The audio signals provided to the amplifier 208 are provided by the processor 210 from an analog output port 212 of the processor 210. Those signals are generated by a conventional digital-to-analog (D/A) convertor inside the processor 210 and therefore not shown in FIG. 2. D/A converters are well known to those of ordinary skill in the art, however, as being commonly found on microcontrollers.

The processor 210 is coupled to a non-transitory memory device 214, which stores executable program instructions for the processor 210. When those instructions are executed by the processor 210, they cause the processor 210 to perform various operations described hereinafter.

The processor 210 and memory 214 are coupled to each other by a conventional bus 216. In one embodiment, the semiconductors from which the processor 210 and memory 214 are made, are co-located on the same semiconductor die.

An audio integrated circuit 218, which is also coupled to the bus 216, has an output port or terminal 219 operatively coupled to an analog input port 220 of the processor 210. The audio integrated circuit (IC) 218 stores files that represent pre-recorded warning messages. Different warning messages are selected from the audio IC 218 by the processor 210 responsive to the processor's determination of the nature of a particular threat or hazard detected and identified from audio signals outside the circum-oral cushion 202.

The apparatus 200 additionally comprises a microphone 222, schematically depicted in FIG. 2 as being inside the cushion 202. It is configured or located anywhere, however, so long as it is able to detect sound waves, including sound waves around a vehicle, and transduce those sound waves into electrical signals. In a preferred embodiment, the microphone 222 is a broadband non-directional microphone, which is able to detect and transduce signals regardless of their direction of orientation.

Electrical signals from the microphone 222 are coupled into a conventional analog-to-digital convertor 226. The analog-to-digital convertor 226 converts time-varying electrical signals into digital representations or binary values, which are output from the A/D convertor 226 at a data output port 228.

A conventional digital signal processor 230 receives a stream of binary or digital signals output from the A/D convertor 226 and performs a conventional Fast Fourier Transform on those digital signals. The digital signal processor or DSP 230 has a digital output port 232 from which a stream of binary values is output, the values representing magnitudes of various different frequency components of the analog signals obtained from the microphone 222. Stated another way, the DSP 230 provides a second stream of digital signals representing different audio frequency components output from the A/D convertor 226.

The first processor 210 executes program instructions stored in the memory device 214 which when executed cause the processor 210 to search the digital stream output from the DSP 230 for the frequency components of various train horns. The combinations of various frequency components associated with different train horn models are stored in a table in the memory device 214. Stated another way, the table in FIG. 1 is essentially stored in the memory device 214. When the frequency components of a train horn are "found" in a sound detected by the microphone 222, a train horn is assumed to be operating nearby.

By way of example, the processor 210 executes instructions stored in the memory 214, which cause the processor 210 to search the signals output from the DSP for the different frequency components characteristic of one of the five-chime horns listed in FIG. 1. In one example, the processor 210 searches for frequencies at 277 Hz., 330 Hz., 392 Hz., 440 Hz., and 554 Hz. Upon detecting those frequency components from the DSP, program instructions in the processor 210 cause the processor to select a warning audio file from the audio IC 218, the content of which "warns" of the presence or approach of a train. Stated another way, the processor "concludes" that a train having a P5 horn is being operated somewhere nearby. Program instructions thus cause the processor to select a warning message from the audio IC 218 and output that message to the driver 204 through the analog output port 212. A user wearing the device 200 or a driver inside a vehicle can thus be made aware that his or her "surroundings" include a train locomotive.

In a preferred embodiment, the processor 210 executes program instructions from the memory 214, which cause the processor to continuously search the incoming data from the DSP 230. The processor 210 continuously searches for different patterns of audio frequency signals, the combined presence of which indicate or suggest different types of safety threats or dangerous conditions to be avoided. By way of example, the presence of all five audio frequencies in any one column of FIG. 1 suggests that a train horn is being operated nearby. Similarly noise having a particular spectral characteristic generated by vehicle tires travelling over a road surface suggests a nearby presence of automobile and truck traffic. The presence of various frequency signals commonly output from an automobile horn at least suggests the presence of an automobile, the horn of which is being operated by the driver, suggesting the presence or proximity of a vehicle the driver which is attempting to warn someone of its presence.

Still referring to FIG. 2, in an alternate embodiment, the noise-cancelling headphones with surroundings awareness is provided with a global positioning system 250. The GPS 250 is coupled to the processor 210 through an output data port 254 of the GPS 250 and which is coupled into a data input port of the processor 210. Digital data 252 output from the GPS 250 corresponds to or identifies a current location of the GPS 250 and hence the headphones 200 to which the GPS 250 is attached.

The data 252 output from the GPS 250 identifies a current location of the GPS and permits the processor 210 to compare a current location with pre-stored locations or coordinates corresponding to railroad tracks, roadways or other "physical threats" that a user or wearer of the headphones should be notified about.

In the alternate embodiment, the processor 210 executes program instructions stored in the memory device 214 which when executed causes the processor to compare a current location, as determined by the GPS 250, to location data, also stored in the memory 214. The execution of those instructions cause the processor to determine whether the current location is within some predetermined distance of a railroad, roadway or other physical threat. The predetermined distance is a design choice.

Figure 3:
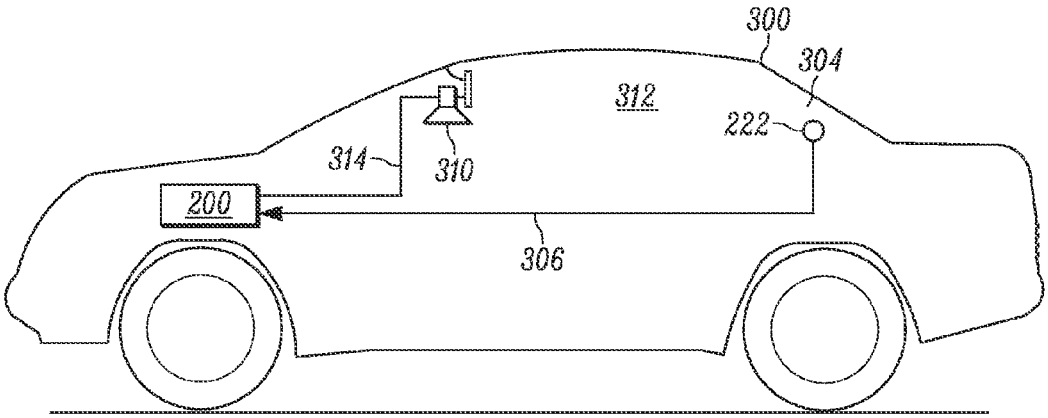
FIG. 3 depicts a motor vehicle, provided with the apparatus shown in FIG. 2.

FIG. 3 depicts a motor vehicle 300 provided with the apparatus 200 for providing surroundings awareness. The microphone 222 is attached to an exterior surface 304 of the vehicle 300 in order to allow the microphone to detect or transduce sounds outside the vehicle 300. The microphone 222 is electrically connected to the DSP 224 through a cable 306, preferably shielded. Although a single microphone is shown in FIG. 3, multiple microphones may be used.

When a predetermined set of audio frequencies is detected, such as the audio frequencies produced by various different train horns, an audible warning message is selected by the processor 210, not visible in FIG. 3, and output from a loud speaker 310, also considered to be an audio driver, located inside the passenger compartment 312, by way of a conventional wire or cable 314. A wireless connection between the apparatus 200 and the speaker 310 may be used instead. The apparatus 200 may send a notification to one or more smartphones. The apparatus shown in FIG. 2 thus provides surroundings awareness to an automobile or other motor vehicle by recognizing certain sounds, the component frequencies of which are known in advance and therefore predetermined.

Figure 4:
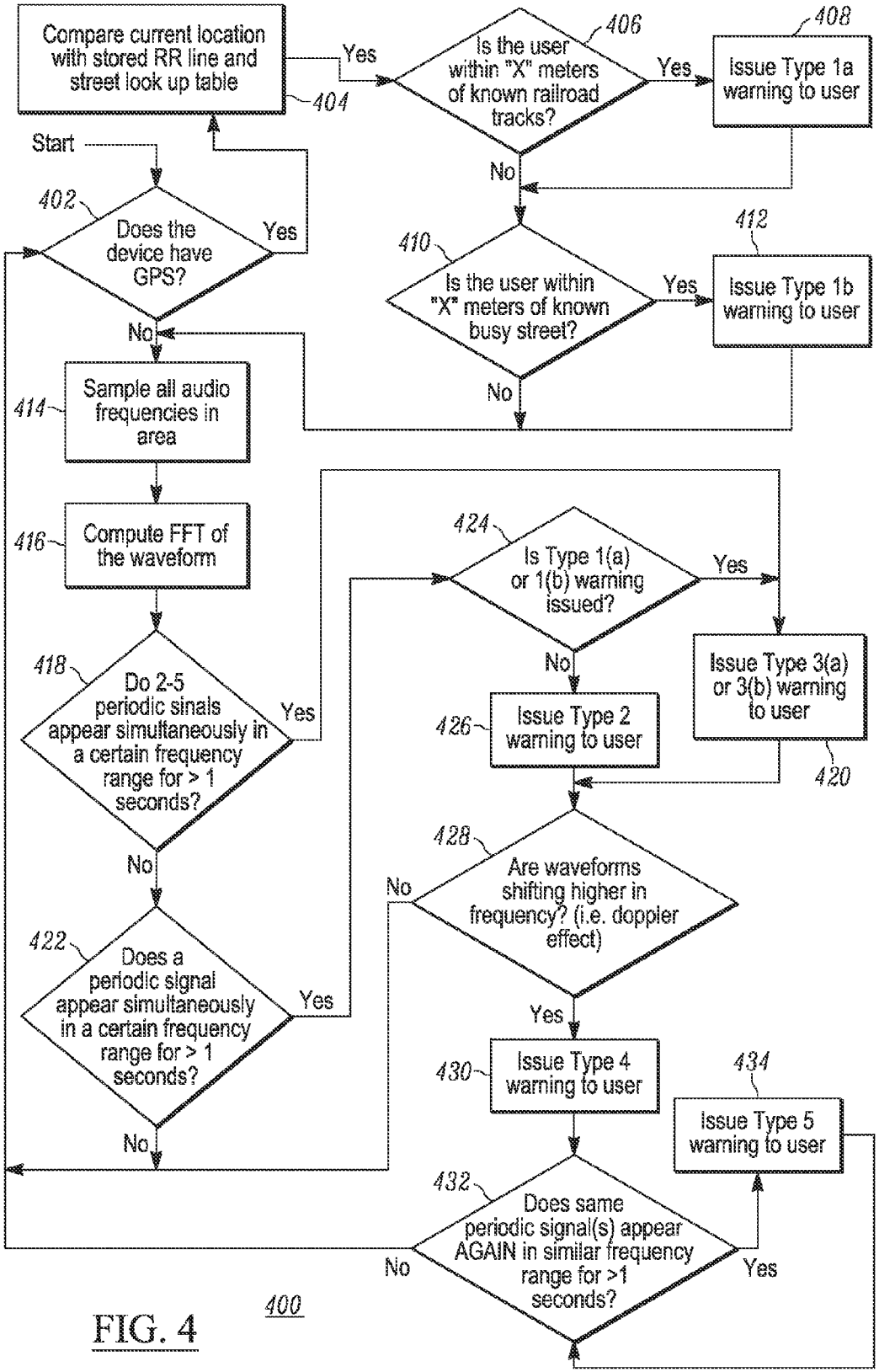
FIG. 4 is a flow chart depicting steps of a method of providing surroundings awareness using sound recognition.

FIG. 4 is a flowchart depicting steps of a method 400 of providing surroundings awareness by recognizing sounds. The method 400 contemplates the possible inclusion of a global positioning system by which a current location might be obtained. It also contemplates the presence of such a device but its inoperability.

At a first step 402, a determination is made whether an apparatus for detecting various sounds and providing surrounding awareness has a global positioning system receiver and if it does, whether the requisite satellite signals are present. If a GPS system is present, at a second step 404, a current location is obtained from the GPS device and a comparison is made between the current location and a table or database of existing and known locations of railroad lines and streets. Once the current location of the GPS is compared with known locations of railroad lines and streets stored in memory, a decision is made at step 406 whether the current location is too close to an existing railroad line or street. Whether the current location is too close to a safety threat such as a rail line, street or roadway is a design choice.

If as a result of the test made at step 406 a safety threat is considered to be too close, a particular type of warning is issued at step 408. Such a warning can be provided by the processor 210 shown in FIG. 2, reading a particular audio message from the audio IC 218 and broadcasting that message from the audio driver 204 or the speaker 310 inside a passenger compartment 312. Conversely, if it is determined that the current location is not within the predetermined safe separation distance for a particular safety threat, at step 410 a second test is made whether the current location is within a predetermined distance of a second type of safety threat, such as a known street or roadway. If the test made at step 410 is affirmative, which means the current location is too close to a street or roadway, a second type of warning is issued to the wearer at step 412.

If the tests at step 410 fails, or after the second type of warning is issued to the user at step 412, the process proceeds to step 414, which is also executed when the test performed at step 402 fails. Which is to say, step 414 and the steps thereafter are executed if there is no GPS device or GPS satellite signals to provide a current location.

Referring now to step 414, using an apparatus such as the one depicted in FIG. 2, detectable audio signals are sampled.

At step 416, the Fast Fourier Transform or "FFT" of the detected audio signals is computed, the result of which is a series of digital values identifying the magnitude and frequency of various audio signals nearby.

At step 418, the frequencies of the signals detected at 414 are tested to determine whether those signals are the same as, or typical of, signals generated by various known-in-advance and therefore "predetermined" safety threats. At step 418, a test is made to determine whether a locomotive horn is being heard, namely, by the determination of whether 2 to 5 periodic signals appear at the same time in a frequency range for at least one second. Such a test should detect and recognize any one of the five train horn output spectra shown in FIG. 1.

If the test performed at step 418 is positive, a third type of warning is issued to the user at step 420. Conversely if the test at step 418 is negative, the method proceeds to step 422 where a second test is performed, namely a determination whether a periodic signal appears in a different frequency range for at least one second. Such sounds would be typically produced by road noise or a passing train in which case a subsequent test at step 424 is performed namely, determining whether a train warning or roadway warning had already been issued. If the result of the test at step 424 is positive, the third type warning is issued, which would be appropriate in the case of a train or roadway noise that might also be present with a train whistle or roadway noise.

If the test at step 424 fails, a yet different type of warning is issued to the user at step 426. At step 428, a test is made whether the wave forms of the sampled audio frequencies are shifting higher in frequency suggesting that the source of the sound waves is moving toward the user. If the result of such a test is negative, the program returns to step 202 where the method is repeated. If the result of the test at step 428 is positive, meaning that the source of the problematic noise is toward the user, it can be assumed that the frequency is increasing or the same in either case indicating that the source of the noise is approaching. A fourth type of warning is issued then at step 430 and repeated in steps 432 and 434. In an embodiment, a user can deactivate selected types of warnings, such as, warnings triggered by close proximity to busy streets.

Those of ordinary skill in the art will recognize that the content of an audible warning provided upon the detection of a safety threat by the recognition of certain audio frequency signals is a design choice. The foregoing description is for purposes of illustration only. The true scope of the invention is set forth in the following claims.

What is claimed is:

1. A method of detecting and warning of a nearby hazard, the method comprising:

determining a current location from a global positioning system;

comparing the current location with stored locations of predetermined hazardous locations;

determining if the current location is within a predetermined distance of a predetermined hazardous location;

if the current location is within the predetermined distance of a hazardous location, issuing an audible warning through an audio driver that a hazard is nearby;

if the current location is not within the predetermined distance of a hazardous location, then performing the steps of:

sampling audio frequency signals that are obtained from a microphone;

computing a Fast Fourier Transform of the sampled audio frequency signals to provide frequency domain representations of the sampled audio frequency signals;

determining from frequency domain representations of sampled audio frequency signals, whether a predetermined number of periodic signals are in predetermined frequency ranges, the predetermined frequency ranges corresponding to predetermined hazards;

if a predetermined number of periodic signals are within the predetermined frequency ranges, issuing an audible warning that a hazard is nearby.

2. The method of claim 1, wherein the stored locations of predetermined hazardous locations comprise at least one of: a railroad track and a vehicular roadway; and wherein said sampled audio frequency signals are samples of audio frequency signals produced by at least one of: a train horn and vehicle traffic on a roadway.

* * * * *